US007337687B2

(12) United States Patent
Okumoto et al.

(10) Patent No.: US 7,337,687 B2
(45) Date of Patent: Mar. 4, 2008

(54) STARTER HAVING PINION-ROTATION-RESTRICTING MECHANISM FOR USE IN AUTOMOTIVE VEHICLE

(75) Inventors: Kazushige Okumoto, Kariya (JP); Masami Niimi, Handa (JP); Tsutomu Shiga, Nukata-gun (JP)

(73) Assignee: Denso Corporation, Kariya (JP)

( * ) Notice: Subject to any disclaimer, the term of this patent is extended or adjusted under 35 U.S.C. 154(b) by 630 days.

(21) Appl. No.: 10/824,372

(22) Filed: Apr. 15, 2004

(65) Prior Publication Data

US 2004/0211273 A1 Oct. 28, 2004

(30) Foreign Application Priority Data

Apr. 25, 2003 (JP) ..... 2003-121985

(51) Int. Cl.
*F02N 11/00* (2006.01)

(52) U.S. Cl. ..... 74/6; 74/7 R

(58) Field of Classification Search ..... 74/7 A, 74/7 R, 7 E

See application file for complete search history.

(56) References Cited

U.S. PATENT DOCUMENTS 5,767,585 A 6/1998 Shiga et al.
6,114,772 A * 9/2000 Araki et al. ..... 290/48
6,142,028 A * 11/2000 Soh ..... 74/7 C

* cited by examiner

*Primary Examiner*—William C. Joyce
(74) *Attorney, Agent, or Firm*—Oliff & Berridge, PLC

(57) ABSTRACT

A starter for cranking an internal combustion engine is composed of an electric motor, an output shaft driven by the electric motor, a pinion gear unit helical-spline-coupled to the output shaft, and a magnetic switch for supplying electric power to the electric motor in an ON-and-OFF fashion and for engaging or disengaging the pinion gear unit with a ring gear of the engine. The pinion gear unit is made by fixedly connecting a pinion gear, a rotation-restricting ring and a bearing member together. These components are separately formed from one another and then assembled to a unitary body of the pinion gear unit. Therefore, they can be forged with simple dies, or may be manufactured by other methods such as machining.

1 Claim, 7 Drawing Sheets

STARTER HAVING PINION-ROTATION-RESTRICTING MECHANISM FOR USE IN AUTOMOTIVE VEHICLE

CROSS-REFERENCE TO RELATED APPLICATION

This application is based upon and claims benefit of priority of Japanese Patent Application No. 2003-121985 filed on Apr. 25, 2003, the content of which is incorporated herein by reference.

BACKGROUND OF THE INVENTION

1. Field of the Invention

The present invention relates to a starter for cranking an internal combustion engine, the starter having a mechanism for establishing engagement of a pinion gear with a ring gear of the engine by restricting rotation of the pinion gear.

2. Description of Related Art

An example of this type of starter is disclosed in JP-A-9-42123. A portion of this starter is illustrated in FIG. 11 attached hereto. A pinion gear unit 100 composed of a pinion gear 110, a rotation-restricting ring 120 having depressions 121 on the outer periphery thereof and a thrust bearing 130 is coupled to an output shaft 150 of the starter by means of a helical spline. Rotation of the pinion gear unit 100 is restricted by engaging an engaging portion 140 of a pinion-rotation-restricting member with the depressions 121, while the output shaft 150 is slowly driven by an electric motor. The pinion rear unit 100 helical-spline-coupled to the output shaft 150 is pushed forward toward the ring gear, thereby establishing engagement between the pinion gear 110 and the ring gear. Then, the restriction of rotation of the pinion gear unit 100 is released, and the output shaft 150 is rotated at a full speed to crank up the engine. After the engine is started, the pinion gear unit 100 is returned to its original position.

In the starter briefly described above, since the pinion gear 110 and the rotation-restricting ring 120 are integrally formed, the die for forging the integral body becomes complicated, and accordingly its manufacturing costs become high. Further, in case the outer diameter of the pinion gear 110 is larger than the outer diameter of the rotation-restricting ring 120, a high level forging technology will be required.

SUMMARY OF THE INVENTION

The present invention has been made in view of the above-mentioned problem, and an object of the present invention is to provide an improved starter, in which a pinion gear unit is formed by assembling a pinion gear, a rotation-restricting ring and a bearing member, separately made from one another. In this manner, the pinion gear unit is easily manufactured at a low cost, or it may be manufactured by other methods than forging.

The starter includes an electric motor, an output shaft driven by the electric motor, a pinion gear unit coupled to the output shaft by means of a helical spline. The pinion gear unit is composed of a pinion gear to be engaged with a ring gear of an internal combustion engine and a rotation-restricting ring fixedly connected to the pinion gear. The pinion gear unit is slidably pushed forward toward the ring gear by restricting its rotation while the output shaft is slowly driven by the electric motor. When the pinion gear engages with the ring gear, the restriction of the pinion gear is released to allow the pinion gear to be driven at a full speed. After the engine is cranked up, the pinion gear unit returns to its initial position by a biasing force.

The components of the pinion gear unit, i.e., the pinion gear and the rotation-restricting ring are formed separately from each other, and fixedly connected to each other not to make relative rotation. A bearing member for absorbing friction between the pinion gear unit and a member for pushing the pinion gear unit forward may be connected behind the rotation-restricting ring. Since the components constituting the pinion gear unit are formed independently from one another, dies used for forging them can be simplified to thereby reduce the manufacturing costs. Those components may be manufactured by other methods than forging, e.g., by machining. A cylindrical portion may be formed on the pinion gear so that the rotation-restricting ring, or both of the rotation-restricting ring and the bearing member, is easily assembled to the pinion gear in a coaxial relation.

The rotation-restricting ring and the bearing member may be connected together before they are assembled to the ring gear. Alternatively, the bearing member may be integrally formed with the rotation-restricting ring. As the bearing member, a thrust ball bearing or a radial ball bearing may be used, or, other types of bearing such as an oil-impregnated porous metal may be used. A seal member for preventing foreign particles from entering the bearing member may be added to the bearing member.

Other objects and features of the present invention will become more readily apparent from a better understanding of the preferred embodiments described below with reference to the following drawings.

DETAILED DESCRIPTION OF THE PREFERRED EMBODIMENTS

Figure 1:
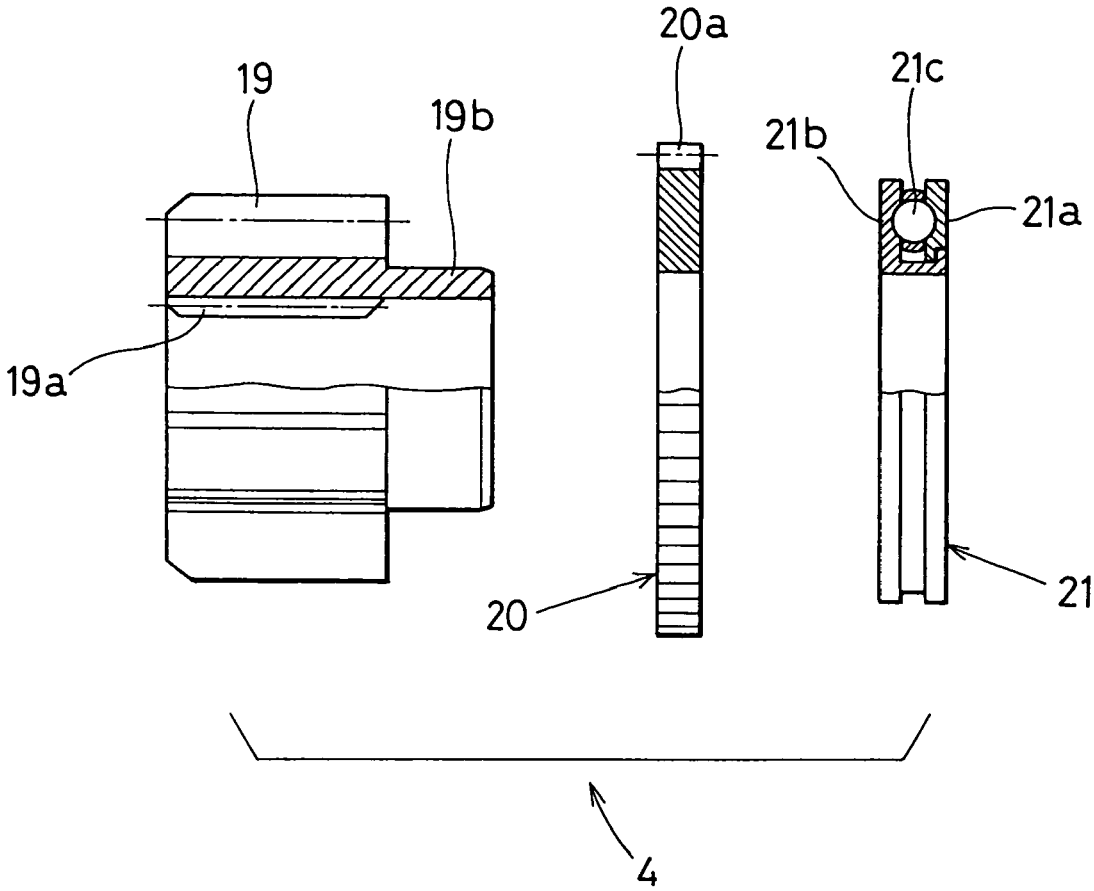
FIG. 1 is a side view (partially cross-sectioned) showing a pinion gear unit as a first embodiment of the present invention, the pinion gear unit being composed of three components separately shown.

A first embodiment of the present invention will be described with reference to FIGS. 1-3. A starter 1 for cranking an internal combustion engine includes: an electric motor 2; an output shaft 3 driven by the electric motor 2; a pinion gear unit 4 slidably coupled to the output shaft 3; a pinion-rotation-restricting mechanism (described later in detail); a member 5 (shown in FIG. 3) for restricting backward movement of the pinion gear unit 4; and other associated components.

The electric motor 2 is a conventional motor having a yoke 6, stationary poles 7 (permanent magnets), an armature 8, brushes 9 and other components. Upon closing a motor switch disposed in a power supply circuit, electric current is supplied to the electric motor 2 from an on-board battery, and the armature 8 is rotated. The output shaft 3 is disposed coaxially with an armature shaft 8*a* and rotatably supported by a bearing 11 fixed to a front housing 10 and another bearing 13 fixed to a center case 12. A male helical spline is formed on a portion of the output shaft 3 extending from the center case 12 to the front side of the starter.

The center case 12 covers a speed reduction mechanism and a one-way clutch both disposed inside the front housing 10. The speed reduction mechanism is a known speed reduction mechanism including planetary gears 14 orbiting around a sun gear while making self-rotation. Rotational speed of the armature 8 is reduced by the speed reduction mechanism. The one-way clutch disposed at the front side of the speed reduction mechanism includes a clutch outer 16, a clutch inner 17 and rollers 18 positioned between the clutch outer 16 and the clutch inner 17. The rotational torque of the armature 8 is transmitted to the clutch outer 16 from axes 15 supporting the planetary gears 14. The rotational torque of the clutch outer 16 is transmitted to the clutch inner 17 integrally formed with the output shaft 3 through the rollers 18. The rotational torque is not transmitted from the clutch inner 17 to the clutch inner 16.

The pinion gear unit 4 is composed of a pinion gear 19 that engages with the ring gear R for cranking the engine, a rotation-restricting ring 20 connected to the rear side of the pinion gear 19 and a bearing member 21 disposed at the rear side of the rotation-restricting ring 20, as shown in FIG. 1. A female helical spline is formed on the inner bore of the pinion gear 19 and coupled to the male helical spline formed on the output shaft 3. The pinion gear unit 4 is biased toward the rear side of the starter 1 by a basing spring 22.

The pinion gear 19 has a cylindrical portion 19*b* extending to its rear side and a female helical spline 19*a* formed on its inner bore. A shutter 23 for covering a front opening of the front housing 10 is disposed in front of the pinion gear 19 and pushed against the pinion gear 19 by the biasing spring 22 so that the shutter 23 moves together with the pinion gear 19. The rotation-restricting ring 20 having a diameter larger than that of the pinion gear 19 is connected to the rear side of the pinion gear 19. A series of depressions 20*a* are formed on the outer periphery of the rotation-restricting ring 20. The bearing member 21 constituting a thrust bearing with a pair of bearing plates 21*a*, 21*b* and balls 21*c* disposed therebetween (shown in FIG. 1) is connected to the rear side of the rotation-restricting ring 20.

The rotation-restricting ring 20 and the bearing member 21 are formed separately from the pinion gear 19, and the cylindrical portion 19*b* of the pinion gear 19 is inserted into both of the rotation-restricting ring 20 and the bearing member 21. The rotation-restricting ring 20 and the bearing member 21 are fixedly connected to the pinion gear 19, e.g., by press-fitting or the like, not to rotate relative to the cylindrical portion 19*b*. Further, both components are fixedly connected to the cylindrical portion 19*b* not to move in the axial direction by staking or the like.

The rotation-restricting member having an engaging portion 24 that engages with the depressions 20*a* of the rotation-restricting ring 20 is driven by a magnetic switch 26 via a crank bar 25. The rotation-restricting member is disposed in a space between a plate 27 and the center case 12. The rotation-restricting member having the engaging portion 24 is biased in the X-direction (shown in FIG. 3) by a return spring 28, and moves in Y direction when driven by the crank bar 25. The rotation-restricting member is formed, e.g., by coiling a resilient metallic bar and by bending both ends thereof in the axial direction, thereby forming the engaging portion 24 and an arm portion 29. The engaging portion 24 extending to the front side of the plate 27 engages with the depressions 20*a* of the rotation-restricting ring 20, when the rotation-restricting member is driven by the crank bar 25, to thereby restrict rotation of the pinion gear unit 4.

The crank bar 25 is made of a metallic bar, and both ends thereof are bent at right angle, forming an operating portion 25*c* that engages with the arm portion 29 of the rotation-restricting member and a coupling portion 25*b* that is coupled to a plunger 31 of the magnetic switch 26. A rod portion 25*a* of the crank bar 25 extends in the axial direction through a space between neighboring magnetic poles 7 in the yoke 6, and is rotatably supported by a pair of bearings (not shown). When the coupling portion 25*b* is driven by the magnetic switch 26, the rod portion 25 is rotated and the operating portion 25*c* moves in the Y direction (FIG. 3), thereby moving the engaging portion 24 of the rotation-restricting member downward against the biasing force of the return spring 28.

The magnetic switch 26, according to operation of an ignition switch (not shown), turns on or off current supplied to the electric motor 2 and drives the crank bar 25 at the same time. The magnetic switch 26 is composed of a solenoid 30 for generating a magnetic field therein, a plunger 31 disposed in the solenoid 30 to be driven upward by the magnetic field, a return spring 32 for biasing the plunger 31 toward its initial position (the position shown in FIG. 2), a pair of movable contacts (a main movable contact 33 and an auxiliary movable contact 34, and a pair of stationary contacts (a main stationary contact 35 and an auxiliary stationary contact 36).

The main movable contact 33 is insulatedly connected to a plunger rod 37 that moves together with the plunger 31 and electrically connected to a plus side brush 9 via a lead wire (not shown). The auxiliary movable contact 34 is electrically connected to the main movable contact 33 through a resilient copper plate 38. The main stationary contact 35 is integrally formed with a terminal bolt 40 that extends through a rear end cover 39 and is fixed thereto. The main stationary contact 35 faces the main movable contact 33. The auxiliary stationary contact 36 is electrically connected to the main stationary contact 35 through a starting resistor 41. The starting resistor 41 made of a coiled nickel wire suppresses an amount of current supplied to the armature 8 when the auxiliary movable contact 34 contacts the auxiliary stationary contact 36. A distance between the main movable contact 33 and the main stationary contact 35 is set larger than a distance between the auxiliary movable contact 34 and the auxiliary stationary contact 36 when the plunger 31 is at the initial position (the position shown in FIG. 2).

Figure 2:
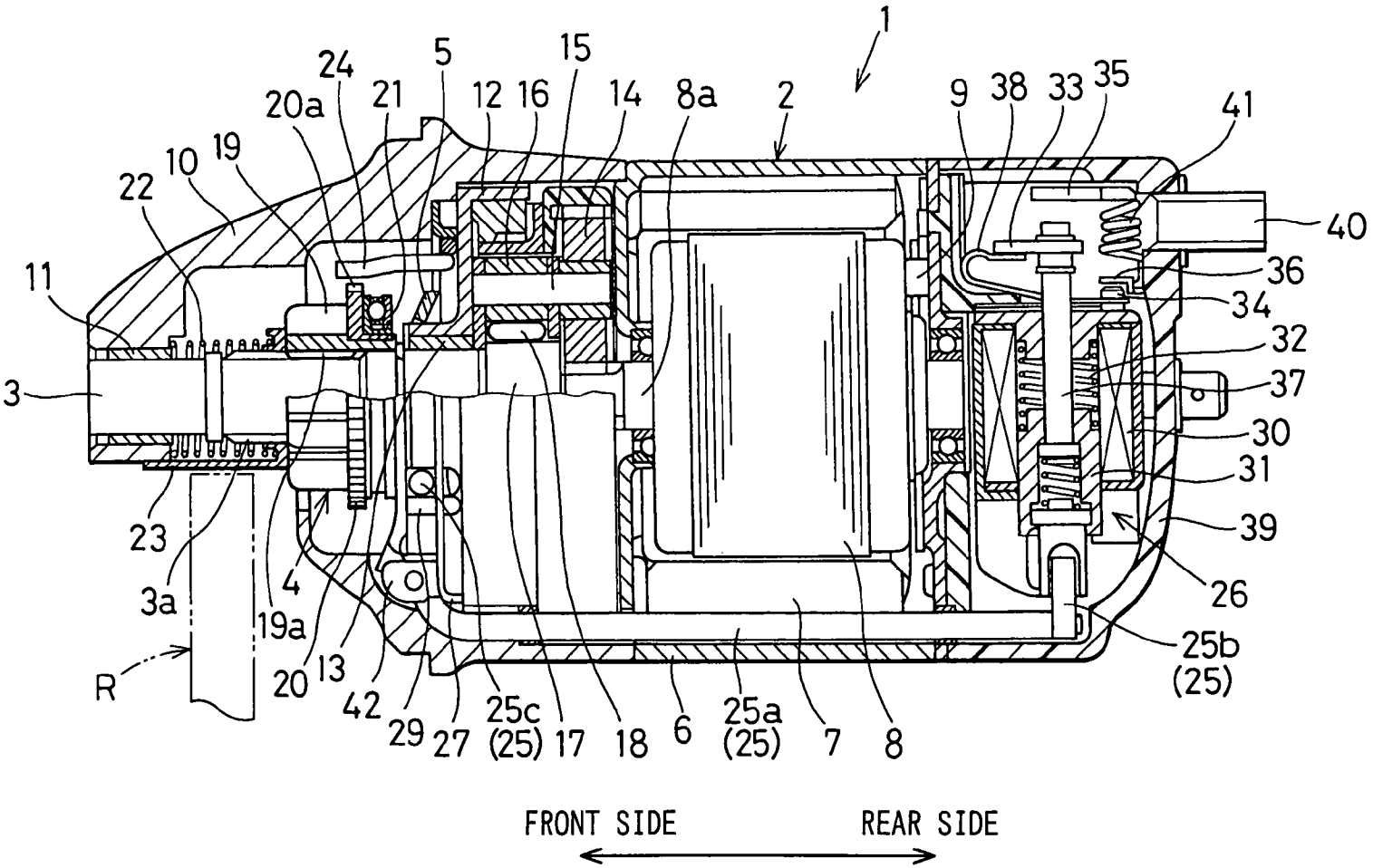
FIG. 2 is a cross-sectional view showing a starter in which the pinion gear unit shown in FIG. 1 is used.
Figure 3:
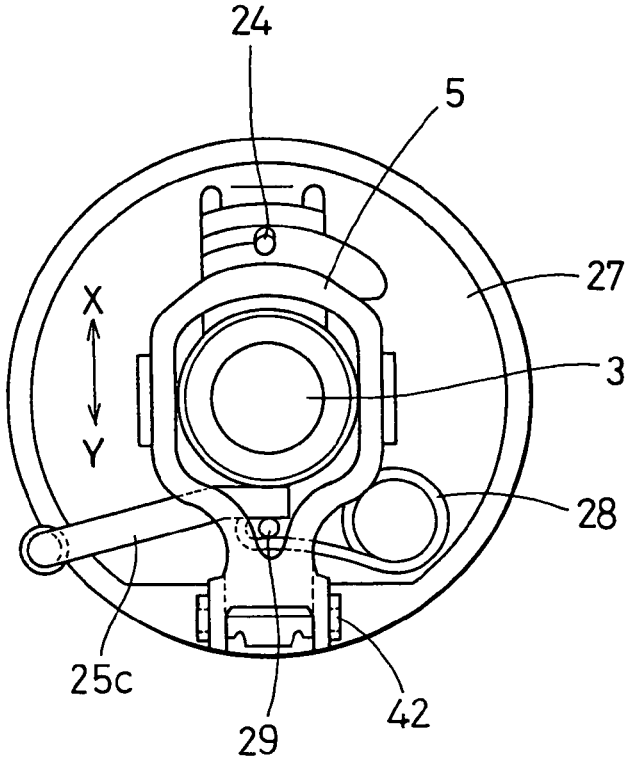
FIG. 3 is a plan view showing a backward-movement-restricting member disposed at a rear side of the pinion gear unit, viewed from a front axial end of the starter.

The backward-movement-restricting member 5 shown in FIGS. 2 and 3 prevents the backward movement of the pinion gear unit 4 in cooperation with the engaging portion 24 after the pinion gear 19 engages with the ring gear R. As shown in FIG. 3, the backward-movement-restricting member 5 has a circular portion disposed around the output shaft 3, and an end of the circular portion is supported by a support 42 fixed to the plate 27 so that the circular portion is able to swing around the support 42. Both sides of the circular portion are held by the bearing plate 21*a* (one of the bearing plates disposed at the rear side).

Now, operation of the starter 1 described above will be described. Upon turning on the ignition switch, current is supplied to the solenoid 30 from the on-board battery, and magnetic force is generated in the solenoid 30. The plunger 31 is driven upward from its initial position shown in FIG. 2 by the magnetic force. According to the movement of the plunger 31, the crank bar 25 coupled to the plunger 31 rotates and the rotation-restricting member having the engaging portion 24 is driven downward (in Y direction shown in FIG. 3). The engaging portion 24 engages with the depression 20*a* of the rotation-restricting ring 20, and thereby the rotation of the pinion gear unit 4 is restricted.

On the other hand, according to the movement of the plunger 31, the auxiliary movable contact 34 first contacts the auxiliary stationary contact 36, and thereby current, the amount of which is limited by the starting resistor 41, is supplied to the armature 8. The armature 8 rotates at a low speed. The rotational speed of the armature 8 is reduced by the planetary gear reduction mechanism and transmitted to the output shaft 3 through the one-way clutch. The output shaft 3 rotates at a low speed. Since rotation of the pinion gear unit 4 helical-spline-coupled to the output shaft 3 is restricted, the unit 4 cannot rotates but moves forward (toward the ring gear R) on the output shaft according to the slow rotation of the output shaft 3. Thus, the pinion gear 19 engages with the ring gear R of the engine.

When the pinion gear 19 engages with the ring gear R, the engaging portion 24 disengages with the depression 20*a* and is positioned behind the backward-movement-restricting member 5 (at the rear side of the member 5). Thus, the posture of the backward-movement-restricting member 5 which is held by the bearing plate 21*a* of the bearing member 21 is kept at the position for preventing the backward movement of the pinion gear unit 4. Accordingly, the pinion gear unit 4 is prevented from moving backward (to the rear side of the starter 1).

Then, the main movable contact 33 contacts the main stationary contact 35. A full amount of current is supplied to the armature 8 from the on-board battery to thereby rotate the armature 8 at a full speed. The ring gear R engaging with the pinion gear 19 is rotated and the engine is cranked up. Upon turning off the ignition switch after the engine is cranked up, the magnetic force in the solenoid 30 disappears and the plunger 31 is returned to its initial position by the biasing force of the return spring 32. According to the movement of the plunger 31, the crank bar 25 rotates and returns to its initial position, thereby removing the force pushing the rotation-restricting member downward (in Y direction shown in FIG. 3). The engaging portion 24 of the rotation-restricting member is disengaged with the depression 20*a* of the rotation-restricting ring 20 by the biasing force of the return spring 28. At the same time, the engaging portion 24 releases the backward-movement-restricting member 5. As a result, the pinion gear unit 4 is pushed backward (toward the rear side) by the biasing spring 22 and returns to its initial position (the position shown in FIG. 2).

Advantages attained in the first embodiment will be summarized below. Since the pinion gear 19, the rotation-restricting ring 20 and the bearing member 21 are manufactured independently from one another, the dies for forging respective components can be simplified, thereby reducing the manufacturing costs. Further, the pinion gear 19 which is independent from other components can be manufactured by various methods other than forging, e.g., by machining such as hob-cutting or broaching. Further, three components of the pinion gear unit 4 can be standardized component by component to facilitate mass production to thereby attain low manufacturing costs. In addition, the separately made components can be easily assembled since the cylindrical portion 19*b* for aligning axes of the components is formed on the pinion gear 19.

Figure 4:
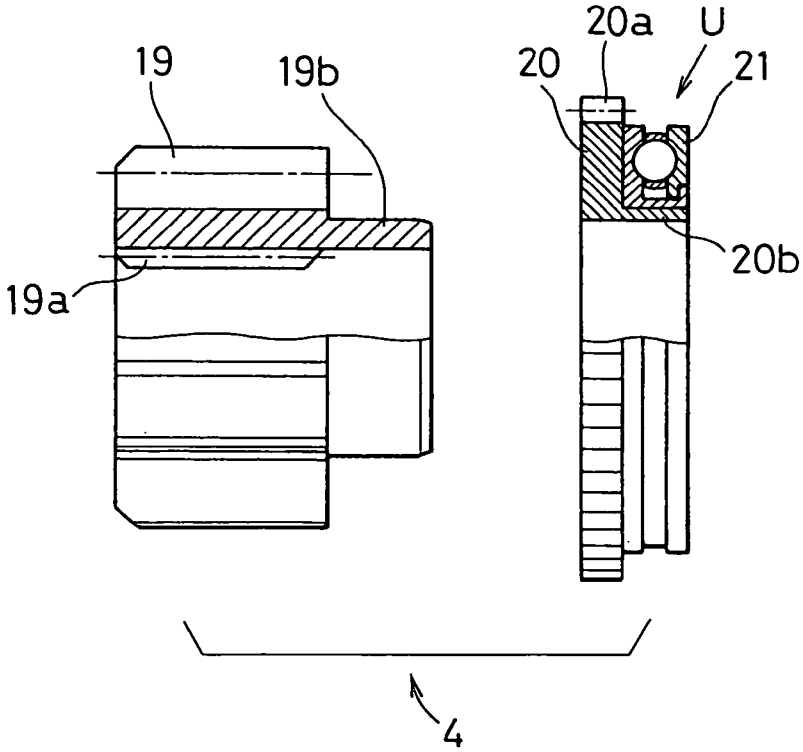
FIG. 4 is a side view (partially cross-sectioned) showing a pinion gear unit as a second embodiment of the present invention, the pinion gear unit being composed of two components separately shown.
Figure 5:
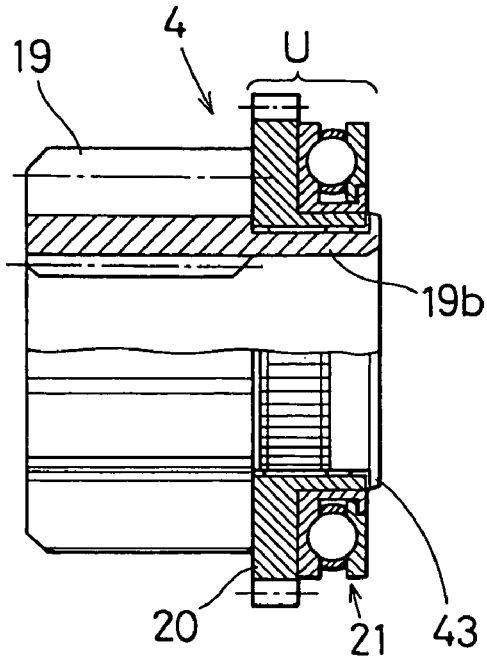
FIG. 5 is a cross-sectional view showing the pinion gear unit formed by connecting two components shown in FIG. 4.

A second embodiment of the present invention will be described with reference to FIGS. 4-6. In this embodiment, the rotation-restricting ring 20 and the bearing member 21, both separately made, are assembled together to form a rotation-restricting unit U before both are assembled to the pinion gear 19. For connecting the bearing member 21 to the rotation-restricting ring 20, a cylindrical portion 20*b* is formed on the rotation-restricting ring 20. As shown in FIG. 5, the rotation-restricting unit U is fixedly connected to the pinion gear 19. After the unit U is fixed to the cylindrical portion 19*b* of the ring gear 19, an axial end of the cylindrical portion 19*b* is deformed or staked, forming a stopper portion 43, to fix the unit U to the pinion gear 19 not to move in the axial direction. It is possible to have an outside supplier manufacture the rotation-restricting unit U as a unit separated from the pinion gear 19, and the manufacturing costs can be reduced without increasing administration costs.

Figure 6:
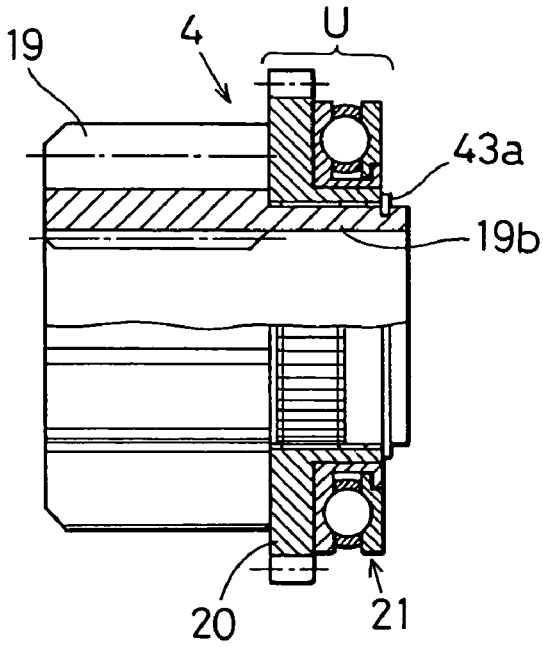
FIG. 6 is a cross-sectional view showing a pinion gear unit slightly modified from the pinion gear unit shown in FIG. 5.

The stopper 43 formed at the axial end of the cylindrical portion 19*b* may be replaced with a clip ring 43*a* connected to the cylindrical portion 19*b*, as shown in FIG. 6. By using the clip ring 43*a*, the cylindrical portion 19*b* can be protected from any damages that might be caused by deforming or staking the same. In addition, the rotation-restricting unit U may be separated from the pinion gear 19 for repair purpose by removing the clip ring 43*a*.

Figure 7:
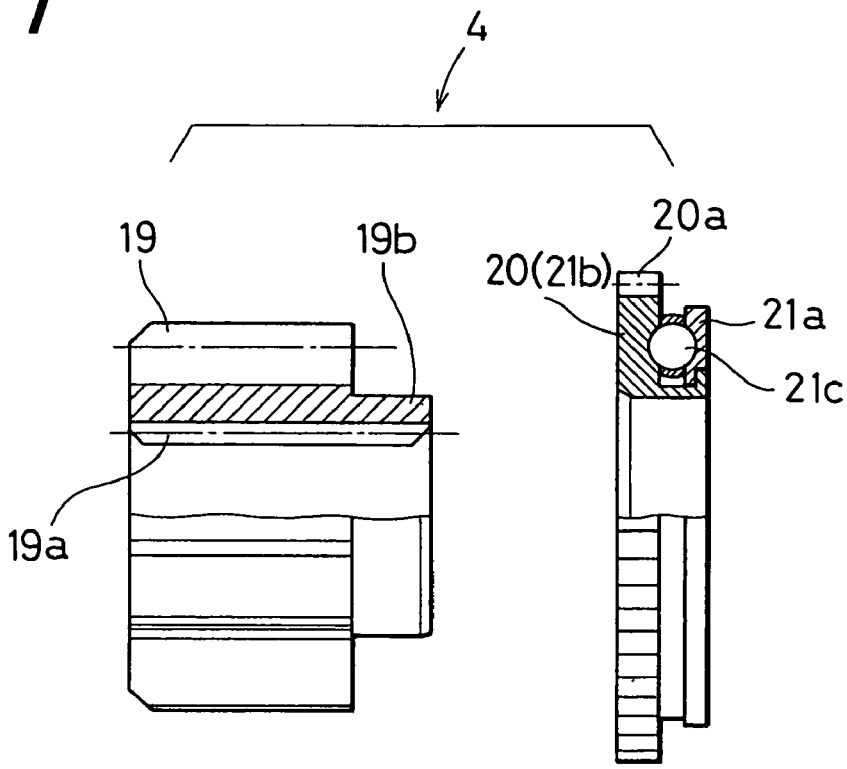
FIG. 7 is a side view (partially cross-sectioned) showing a pinion gear unit as a third embodiment of the present invention, the pinion gear unit being composed of two components separately shown.

A third embodiment of the present invention is shown in FIG. 7. In this embodiment, the bearing member 21 is combined with the rotation-restricting ring 20. More particularly, one of the bearing plate 21*b* has a series of depressions 20*a* on its outer periphery, and the other bearing plate 21*a* and the balls 21*c* are integrally assembled to the bearing plate 21*b*. Thus, the rotation-restricting ring 20 and the bearing member 21 are unified into a single unit. The unified single unit is fixedly connected to the pinion gear 19. In this manner, the number of components forming the pinion gear unit 4 is reduced.

Figure 8A:
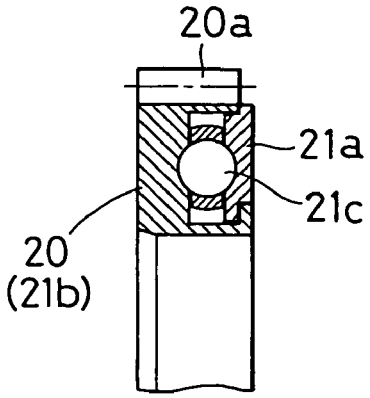
FIG. 8A is a cross-sectional view showing a rotation-restricting unit as a fourth embodiment of the present invention, the rotation-restricting unit including sealing means.
Figure 8B:
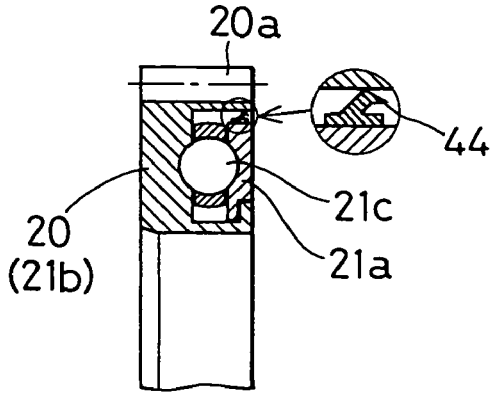
FIG. 8B is a cross-sectional view showing a rotation-restricting unit slightly modified from the unit shown in FIG. 8A.

A fourth embodiment of the present invention is shown in FIGS. 8A and 8B. In this embodiment, the combined unit of the rotation-restricting ring 20 and the bearing member 21 shown in FIG. 7 as the third embodiment is modified to include a seal member for preventing foreign particles from entering the bearing member. In an example shown in FIG. 8A, a labyrinth is formed in a space between the pair of bearing plates 21*a* and 21*b*. In another example shown in FIG. 8B, a seal member 44 is disposed between the pair of bearing plates 21*a*, 21*b*. In this manner, the bearing member 21 is protected from foreign particles or liquid.

Figure 9:
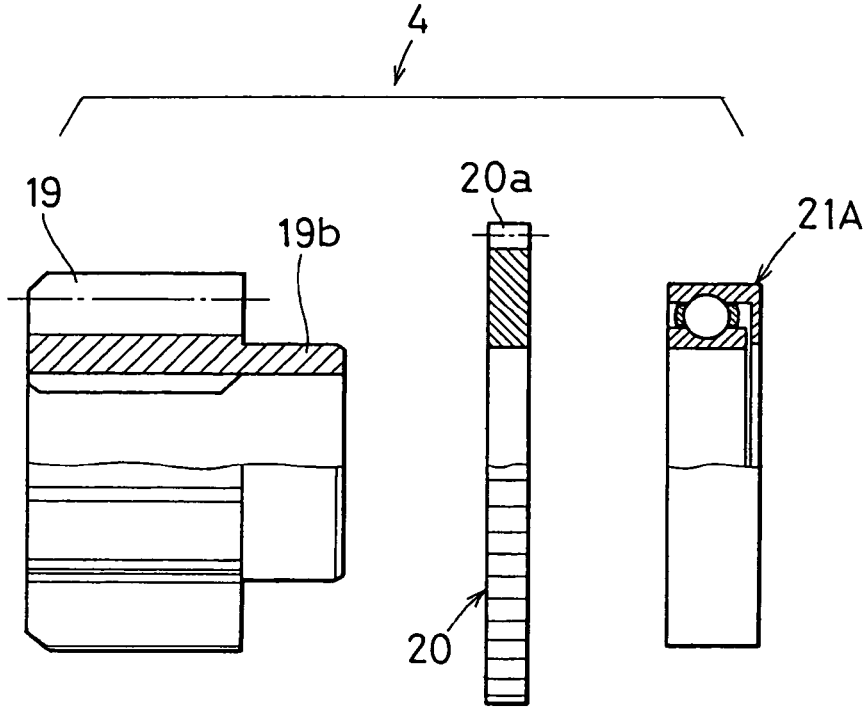
FIG. 9 is a side view (partially cross-sectioned) showing a pinion gear unit as a fifth embodiment of the present invention, the pinion gear unit being composed of three components including a radial ball bearing.
Figure 10:
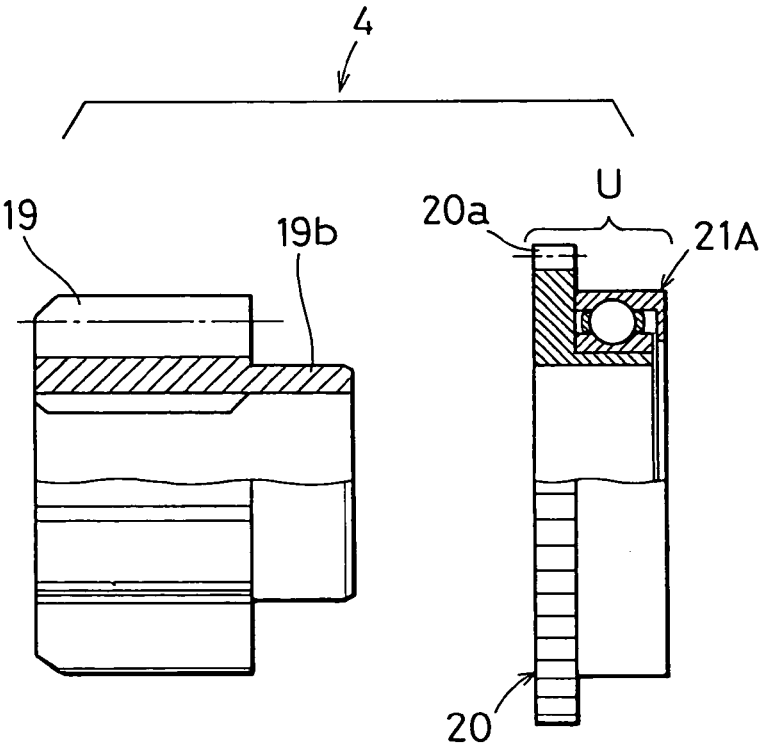
FIG. 10 is a side view (partially cross-sectioned) showing a pinion gear unit modified from the unit shown in FIG. 9.
Figure 11:
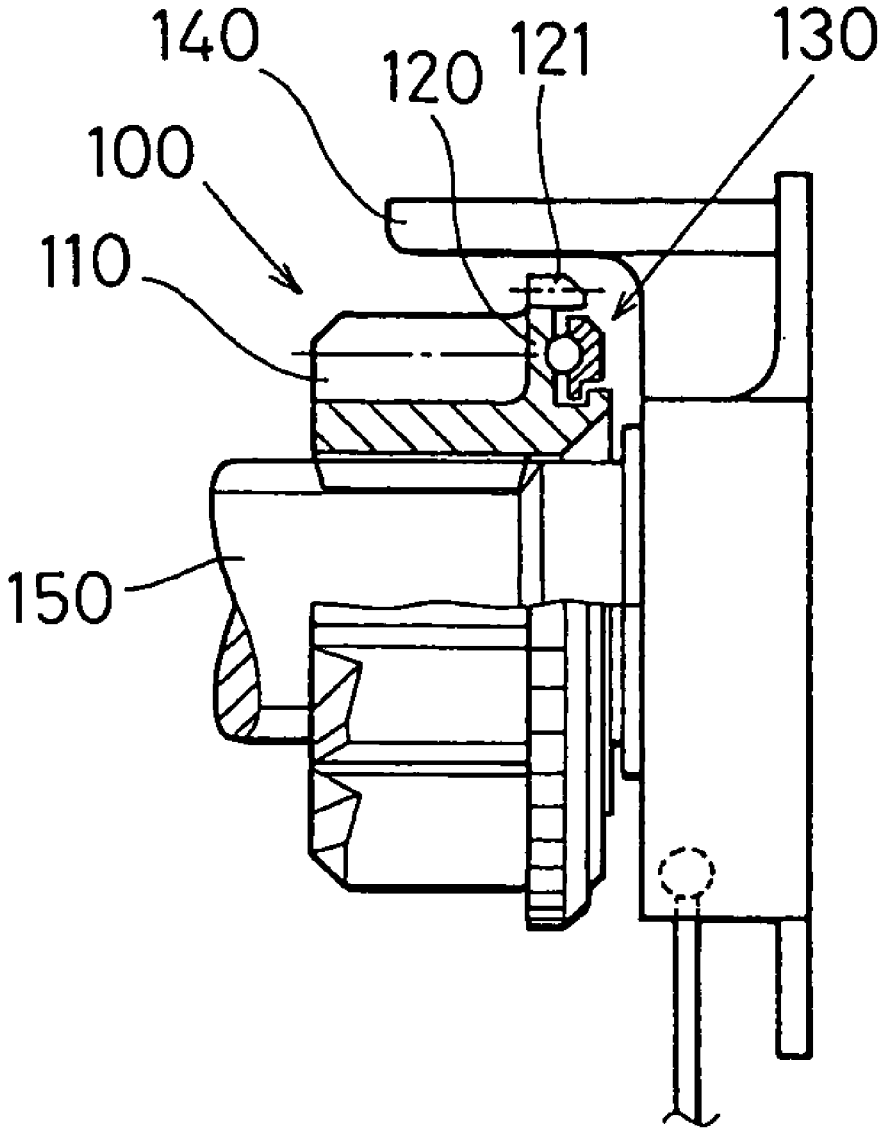
FIG. 11 PRIOR ART
FIG. 11 is an appropriate portion of a conventional starter having a pinion gear unit composed of a pinion gear and a rotation-restricting ring integrally formed with the pinion gear.

A fifth embodiment of the present invention is shown in FIGS. 9 and 10. In this embodiment, the thrust bearing 21 used as the bearing member in the foregoing embodiments is replaced with a radial bearing 21A. In an example shown in FIG. 9, the rotation-restricting member 20 and the radial bearing 21A are separately formed and then both are assembled to the pinion gear 19, thereby forming the pinion gear unit 4. In another example shown in FIG. 10, a rotation-restricting unit U is formed by combining the rotation-restricting ring 20 and the radial bearing 21A, and then the unit U is assembled to the pinion gear 19, thereby forming the pinion gear unit 4.

The present invention is not limited to the embodiments described above, but it may be variously modified. For example, though a ball bearing is used as the bearing member 21 in the foregoing embodiments, other types of bearing such as a bearing using an oil-impregnated porous material may be used in place of the ball bearing. It is also possible to eliminate the backward-movement-restricting member 5 that prevents the backward movement of the pinion gear unit 4 in cooperation with the engaging portion 24 and to use the engaging portion 24 alone as the member for preventing the backward movement of the pinion gear unit 4.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A starter for cranking an internal combustion engine having a ring gear, the starter comprising:

an electric motor;

an output shaft driven by the electric motor;

a pinion gear driven by the output shaft;

a rotation-restricting ring fixedly connected to the pinion gear, the rotation-restricting ring having a series of depressions formed on its outer periphery, the pinion gear being helical-spline-coupled to the output shaft so that the pinion gear is pushed forward toward the ring gear to thereby engage with the ring gear when the output shaft is slowly rotated by the electrical motor and rotation of the pinion gear is restricted;

a rotation-restricting member adapted to be engaged with the depressions of the rotation-restricting ring to restrict rotation of the pinion gear;

a member for restricting backward movement of the pinion gear when the pinion gear is engaged with the ring gear; and a bearing member connected to the rotation-restricting ring for absorbing friction between the rotation-restricting ring and the member for restricting backward movement of the pinion gear, the bearing member being a radial bearing for reducing abrasive force in the radial direction of the pinion gear, wherein the pinion gear, the rotation-restricting ring and the bearing member are formed separately from one another, and the bearing member is first connected to the rotation-restricting ring, and then the rotation-restricting ring is fixedly connected to the pinion gear.

* * * * *